United States Patent [19]

Reynolds et al.

[11] 4,261,629

[45] Apr. 14, 1981

[54] SLOTTED PLATE TERMINAL

[75] Inventors: Charles E. Reynolds, Mechanicsburg; Suel G. Shannon, Harrisburg, both of Pa.

[73] Assignee: AMP Incorporated, Harrisburg, Pa.

[21] Appl. No.: 113,946

[22] Filed: Jan. 21, 1980

[51] Int. Cl.[3] ..... H01R 4/24; H01R 9/09

[52] U.S. Cl. ..... 339/17 C; 339/98; 339/276 SF

[58] Field of Search ..... 339/17 C, 276 SF, 96–99 R

[56] References Cited

U.S. PATENT DOCUMENTS

| | | | |
|---|---|---|---|
| 3,617,983 | 11/1971 | Patton | 339/98 |
| 3,845,455 | 10/1974 | Shoemaker | 339/97 |
| 4,116,522 | 9/1978 | Reynolds | 339/97 R |
| 4,129,349 | 12/1978 | von Roesgen | 339/17 C |

OTHER PUBLICATIONS

AMP Engineering and Purchasing Guide, 1977, pp. 7–15.

*Primary Examiner*—Eugene F. Desmond

*Attorney, Agent, or Firm*—F. Brice Faller; Frederick W. Raring

[57] ABSTRACT

Slotted plate terminal comprises two wire-receiving portions, each having an inner plate-like member with a wire contacting slot therein and an outer plate-like member with a strain relief slot therein. Slots extend inwardly from bights which connect each inner plate-like member to an adjacent outer plate-like member at the wire receiving end. Inner plate-like members are connected by a web opposite the wire receiving end. Outer plate-like members have extensions which extend toward each other then laterally of the web to form a mounting portion. The terminal may be mass produced in strip form. Means for mounting and wire insertion are disclosed.

10 Claims, 11 Drawing Figures

SLOTTED PLATE TERMINAL

FIELD OF THE INVENTION

This invention relates to a conductor-in-slot type terminal intended primarily for mounting on a printed circuit board.

DESCRIPTION OF THE PRIOR ART

Slotted plate terminals where adjacent plates are connected by a bight are well known. U.S. Pat. No. 3,617,983 shows several configurations of such a terminal intended for use with a housing. U.S. Pat. No. 4,118,103 shows a double ended slotted plate connecting device with two bighted double thickness wire receiving portions at one end. Neither of the above is intended for circuit board mounting and they do not exhibit the structural properties of the present invention which permit a very small but sturdy terminal for circuit board mounting. U.S. Pat. No. 3,845,455 is a tubular conductor-in-slot type connecting device which may be mounted on a circuit board, but likewise is not as small or sturdy as the instant invention.

SUMMARY OF THE INVENTION

The present invention is directed to the achievement of a very compact but sturdy terminal which is manufactured by stamping and forming sheet metal. Means for mass producing and automated mounting of the terminals in a circuit board are disclosed, and a means is also disclosed for inserting wires in the terminals which makes the insertion force required for most effective contact compatible with the size of the terminal.

It is accordingly an object of the present invention to provide an improved conductor-in-slot connecting device suitable for mounting on a circuit board. Another object is to provide a very compact terminal which is resistant to bending and other damage. Another object is to provide a slotted plate terminal with integral strain relief for an inserted wire. A further object is to provide a multi-purpose terminal which may be used for feed through, single wire, and two wire termination. A further object is to provide a terminal which may be stamped and formed from sheet metal. Yet another object is provision of a terminal which may be mass produced in strip form. A related object is to provide a terminal which may be severed from the strip in groups for junction applications. Another object is to provide means for inserting an insulated wire in the slotted plates of the terminal with sufficient force to effect very good electrical contact and wire retention without resultant damage to the terminal.

These and other objects of the invention are achieved by the preferred embodiment of the invention which is described in detail below.

DESCRIPTION OF THE PREFERRED EMBODIMENT

Figure 1:
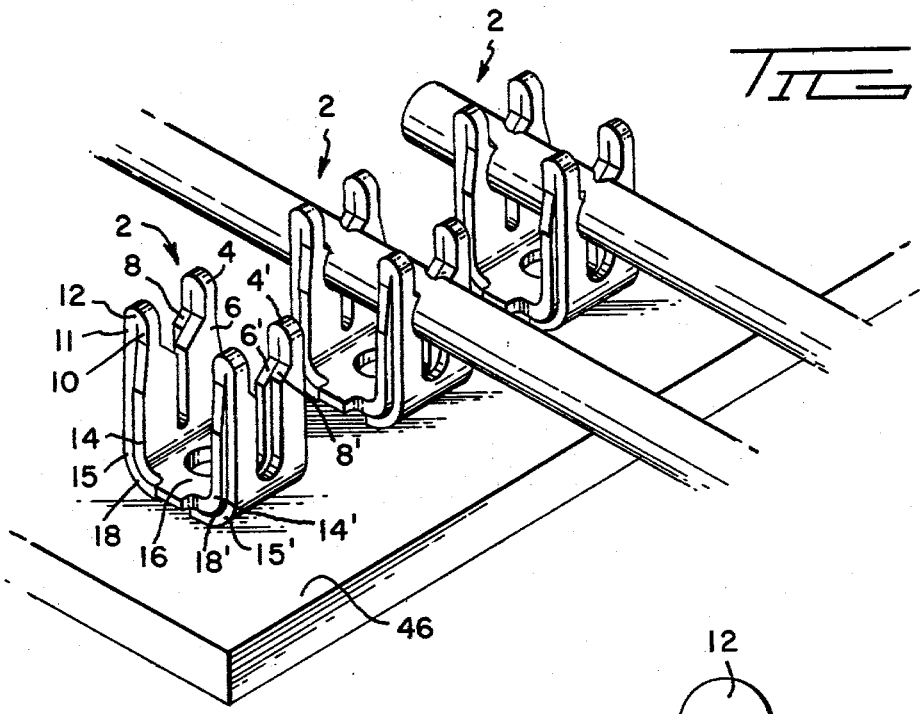
FIG. 1 is a perspective of several terminals mounted in a circuit board, with and without inserted wires.

Referring to FIG. 1, a one piece stamped and formed electrical terminal 2 comprises first and second wire receiving portions 4, 4', each wire receiving portion having an inner plate-like member 6, 6' and an outer plate-like member 8, 8'. Inner plate-like members 6, 6' have remote ends 10, 10' and inner ends 14, 14' while outer plate-like members 8, 8' have remote ends 11, 11' and inner ends 15, 15'. Remote ends 10, 11 are connected by a bight section 12 while remote ends 10', 11' are connected by a bight section 12'are connected by a bight section 12'. The first and second wire receiving portions 4, 4' are in aligned spaced apart relationship with the inner plate-like members 6, 6' facing each other and connected to each other at inner ends 14, 14' by an integral web 16 which extends substantially normally of the inner plate-like members.

In addition to wire receiving portions 4, 4' each terminal 2 has a mounting portion which comprises first and second extensions 18, 18' on the inner ends 15, 15' of the outer plate-like members 8, 8'. The extensions comprise transition sections 20, 20' which extend initially toward each other and retaining sections 22, 22' which extend laterally of the web 16, shown in FIG. 2.

Each of the wire receiving portions 4, 4' has wrie receiving slot means extending inwardly from the bight sections 12, 12' on the inner and outer plate-like members 6, 6', 8, 8' toward the inner ends 14, 14', 15, 15' respectively of the plate-like members. The wire receiving slot means in each of the first and second wire receiving portions comprises a wire contacting slot 24, 24' in the inner plate-like members 6, 6' respectively and a strain relief slot 26, 26' in the outer plate-like members 8, 8' respectively. The wire contacting slot 24, 24' has a width which is less than the diameter of the conducting core of the wire size for which the terminal is intended, and the strain relief slot 26, 26' has a width which is less than the outside diameter of the insulation on the wire and equal to or larger than the diameter of the conducting core. The slot means in the wire receiving portions have flared upper sections 28, 28' and all slots are aligned for reception of a wire.

Figure 3:
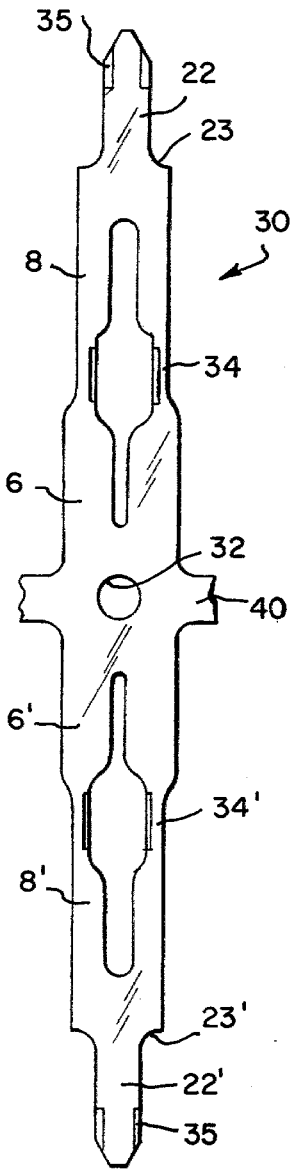
FIG. 3 is a plan view of a blank for a terminal prior to forming.

Contact terminals 2 of the type described are manufactured in the form of a blank 30 as shown in FIG. 3. 90° bends are formed on either side of hole 32 to form the web 16 while 180° bends are formed at necks 34, 34' to form the bight sections 12, 12' respectively and two additional bends of slightly over 90° are formed at each end of the blank to form the transition sections 20, 20' which offset the retaining sections 22, 22' inwardly from the outer plates 8, 8'. Inner plate-like members 6, 6' are slightly wider than outer plate-like members 8, 8' so that when the 180° bends are formed at 34, 34' the inner plates 6, 6' will define the profile of the terminal regardless of minor variations in bending. Pairs of shoulders 23, 23' are blanked in what becomes transition sections 20, 20' so that retaining sections 22, 22' are narrower than wire receiving portions 4, 4' and will fit snugly in a round hold 44. Chamfers 35 are coined onto the retaining sections 22, 22' so that they will conform more closely to the shape of the hole.

Figure 2:
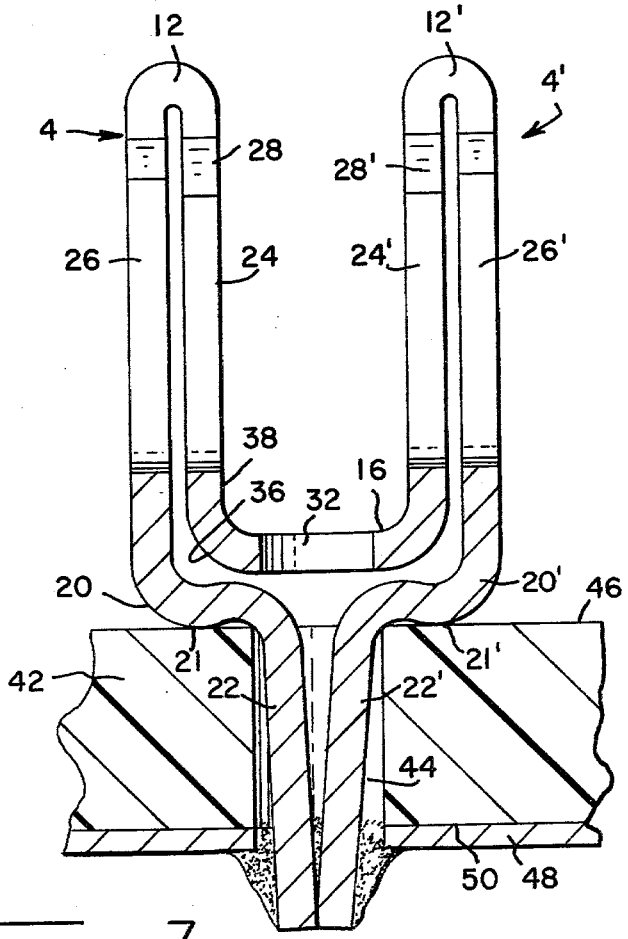
FIG. 2 is a cross sectional view of a terminal mounted in a circuit board.

The actual blanking of the sheet metal to form blank 30 and various apertures therein is important for the properties which the operation lends to the finished terminal. One side of a metal strip is placed against a die while the other side is met with a punch to form a blank, leaving rounded edges on the punch side and burrs on the die side. The blank is then folded so that the burred edges all lie against each other on an internal surface 36 while the rounded edges lie on an exposed surface 38 of the terminal, as shown in FIG. 2. This is especially important in the strain relief slots 26, 26', since lateral forces on an inserted wire will subject it to shear stress only at rounded edges of the slots, while the burred edges serve to grip the wire within the slots.

Figure 4:
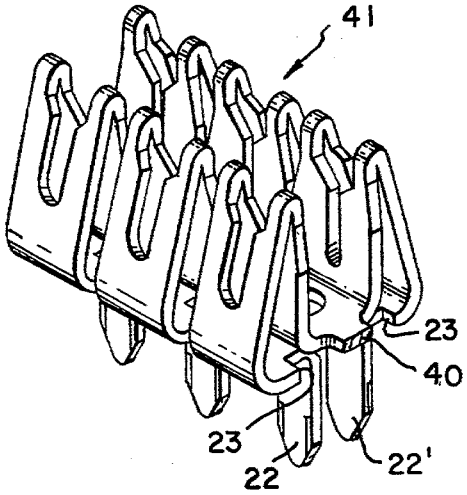
FIG. 4 is a perspective of a strip of terminals prior to mounting or wire insertion.

Referring again to FIG. 3, connecting links 40 serve to connect each blank to an adjacent blank so that terminals can be manufactured in a continuous strip 41 as shown in FIG. 4. Hole 32 is used for handling the strip as terminals are formed from the blanks. The required number of terminals are separated by severing a connecting line 40, and terminals are inserted in a circuit board 42 by squeezing outer plate-like members 8, 8' until retaining sections 22, 22' meet to facilitate insertion in a mounting hole 44. The retaining sections 22, 22' are inserted in the hole 44 until external bearing portions 21, 21' of the transition sections 20, 20' bear against the mounting surface 46 of the circuit board as shown in FIG. 2. Here the purpose of the bends over 90° is evident, as they provide external bearing portions 21, 21' offset from the retaining sections 22, 22', thus improving the stability of the mounted terminal. The stability is further improved by forming the transition sections so that shoulders 23, 23' coincide with the external bearing portions 21, 21'. Note that the retaining sections meet at an angle, which exerts a spring force against the mounting hole 44 to aid retention of the terminal in the board. Retaining sections 22, 22' are then soldered to conductors 48 on the opposite surface 50 of the circuit board 42. The spring concept is also pertinent to other retention/contact schemes, such as blanking or coining serrated edges on the retaining sections to mate with a plated-through hole.

An important feature of the preferred embodiment of the instant invention is the compactness and ruggedness of the terminal. For example, a terminal for 22 gage wire is about 0.10 in. wide by 0.19 in. high (2.5 mm×4.8 mm) as mounted on a circuit board. Thus, while brass or phosphorous bronze on the order of 0.012 in. thick (0.3 mm) is used, the size and structural features of the terminal make it extremely resistant to damage.

A strip of two or more terminals may be used together for junction applications by insertion in a row of closely spaced holes on a circuit board, while it is only necessary for one such hole to be common with a conductor. As the terminals due to their compactness and slot configuration are not meant for terminating more than one wire per slot, the junction configuration permits common termination for a plurality of wires.

Figure 5:
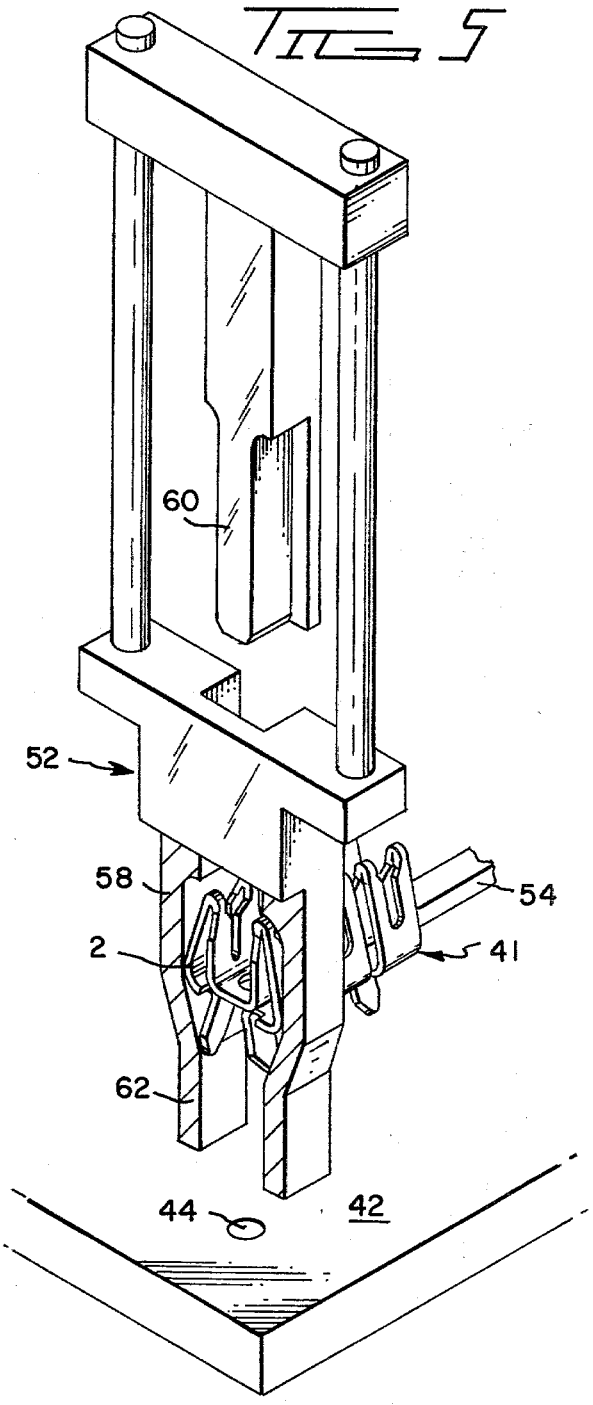
FIG. 5 is a perspective of a mounting device for shearing a terminal from a strip and mounting it in a circuit board.
Figure 7:
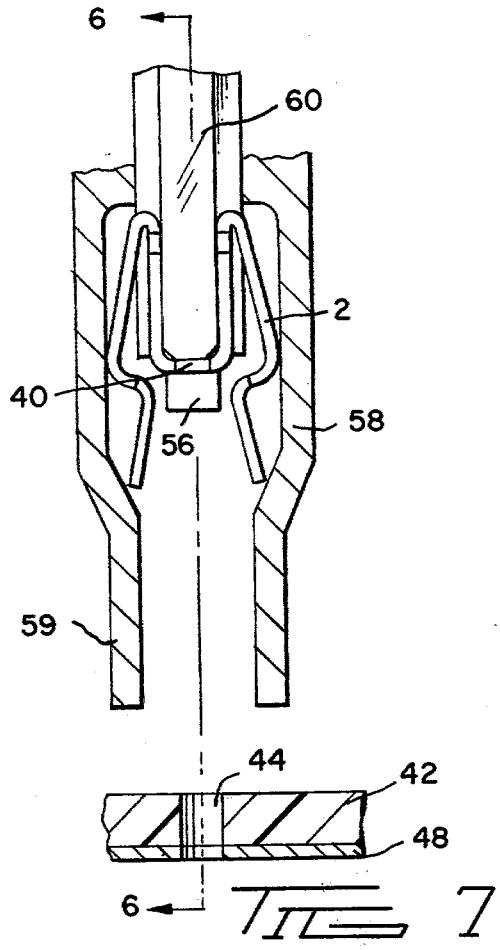
FIG. 7 is a cross sectional view of the guide just prior to shearing.
Figure 8:
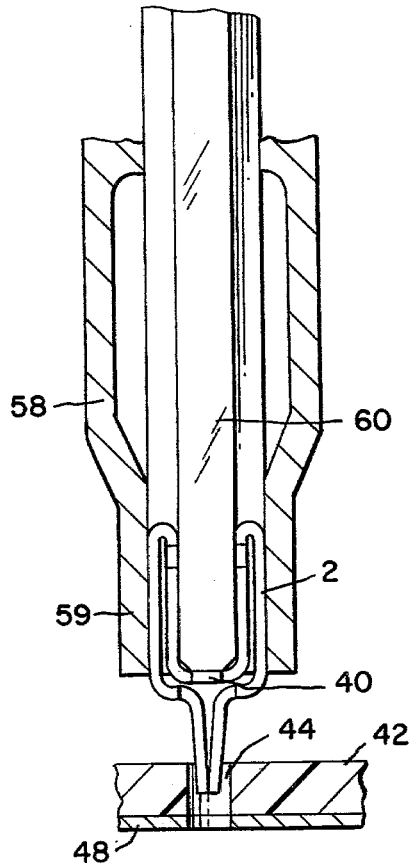
FIG. 8 is a cross sectional view of the guide as the terminal is being mounted.
Figure 6:
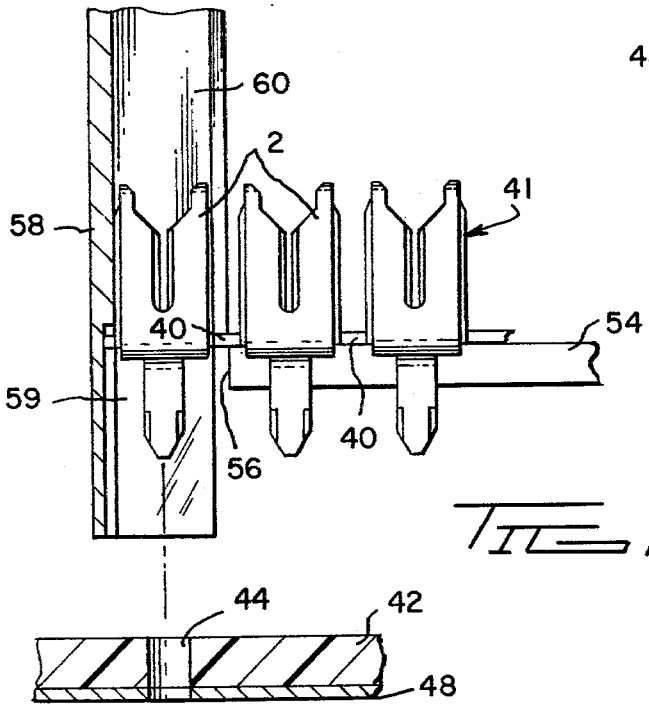
FIG. 6 is a cross-sectional elevation view of the strip feed and guide punch taken along lines 6—6 of FIG. 7.

Severing of discrete terminals from a strip 41 and mounting in a circuit board 42 may be accomplished by a mounting apparatus 52 shown generally in FIG. 5. A continuous strip 41 is fed along a track 54 until a terminal 2 is situated within guide tube 58 with the connecting link 40 situated over shear die 56 at the end of the track, as shown in FIGS. 6 and 7. A guide punch 60 then descends into the tube 58 from above terminal 2, shears the terminal from the strip, then pushes it down through the tube to a compression section 59 where the outer plates 8, 8' of the terminal are compressed inwardly until opposed retaining sections 22, 22' meet. The retaining sections then enter mounting hole 44 as shown in FIG. 8 and downward movement of the guide punch 60 continues until the terminal is fully inserted. At this stage the wire receiving portions 4, 4' have cleared the compression section 59 and the guide punch is raised back through the tube 58 so that the operation may be repeated. The subject apparatus may be fully or partially automated, depending on the size of the job.

Figure 9:
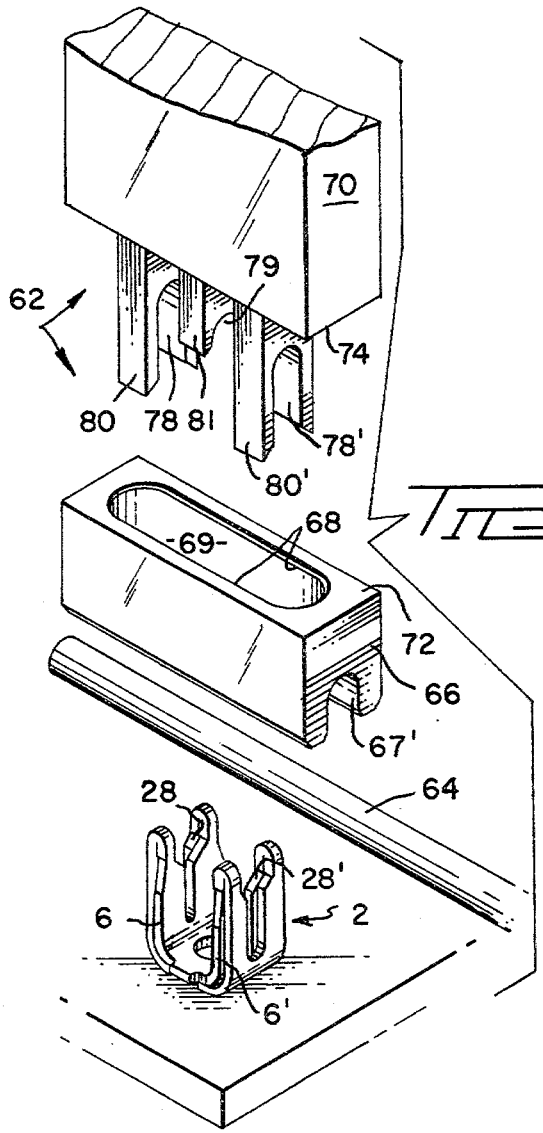
FIG. 9 is an exploded perspective of the wire insertion tool, the wire, and a mounted terminal aligned for wire insertion.

Wire insertion is best accomplished by a two part insertion tool 62, shown with an insulated wire 64 and a mounted terminal 2 in FIG. 9. To accomplish insertion, the wire 64 is first placed in the flared upper sections 28, 28' of the wire receiving portions 4, 4' of the terminal. The shroud section 66 of the tool 62 is then placed over the terminal such that inner walls 68 of the shroud are closely adjacent to the edges of the inner plate-like members 6, 6' of the terminal, and the wire 64 passes through shroud channels 67, 67'. The inserter 70 of the tool 62 is then slid into the aperture 69 defined by inner walls 68 in the shroud 66 until the top surface 72 of the shroud 66 abuts the bottom surface 74 of the inserter 70. At this stage the channels 78, 78' in outer pushers 80, 80' and the channel 79 in the inner pusher 81 are in contact with the wire and aligned with the shroud channels 67, 67'.

Figure 10:
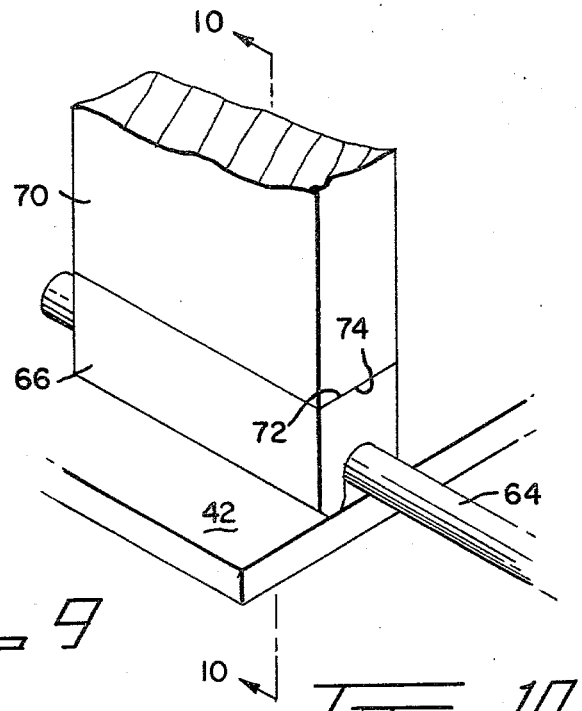
FIG. 10 is a perspective of the tool during insertion.
Figure 11:
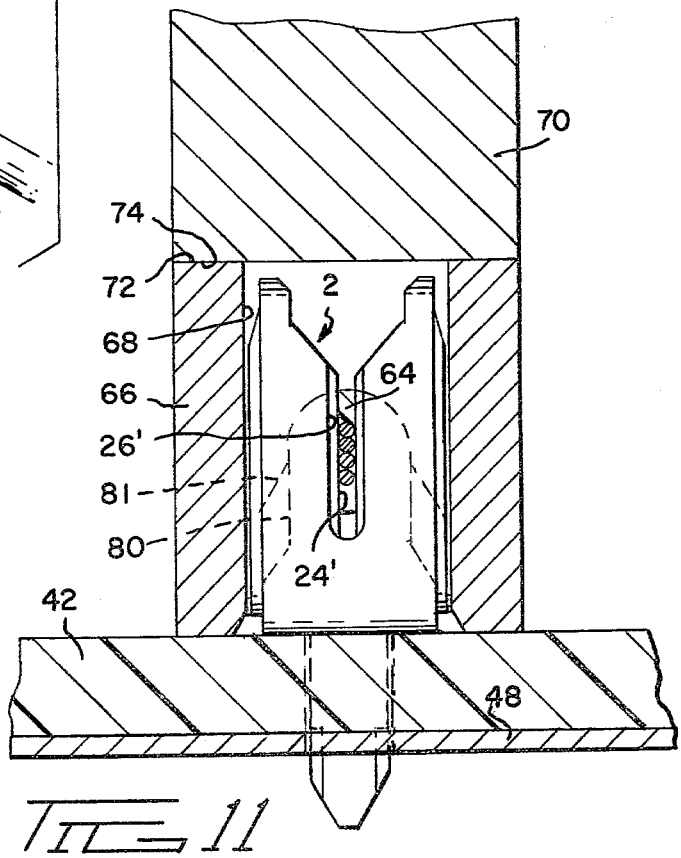
FIG. 11 is a cross sectional view of the tool, terminal, and wire as insertion is completed.

To complete insertion, pressure is brought to bear on the inserter 70 until the shroud 66 contacts the circuit board 42 as shown in FIGS. 10 and 11. During this stage the two parts of the tool act as one. The pushers 80, 80' exert pressure on the wire 64 on the outer sides of the wire receiving portions while pusher 81 exerts pressure on the wire therebetween, thus displacing insulation from the wire and forcing it into the slots. The shroud 66 prevents over-distention of the terminal due to the pressure exerted by the conductive core of the wire as it is forced into the wire contacting slots 24, 24'. Some distention, however, is desirable in order to create the resilient condition necessary for proper physical and electrical contact with the core of the wire. Here the clearance between the inner walls 68 of the shroud and the inner plate-like members 6, 6' becomes important, which is why the width of the terminal is defined by the inner plate-like members.

The physical events occurring during the final stage of wire insertion are best illustrated by examples. A 20 gage solid core insulated wire has a conductive core with a diameter of 0.032 in. and is intended for insertion in a wire contacting slot 0.016 in. across. The conductive core must deform in order to fit into the slot, and it is during this deformation that the greatest force is created on the terminal. Once insertion is completed, the core is already deformed and the shroud may be safely removed.

As a second example consider 20 gage stranded wire. This consists of 7 strands of conductive element each 0.013 in. in diameter which are twisted to form the lay of the wire, which is held in place by insulation. Again a 0.016 wire contacting slot is proper. As the wire is inserted, insulation is displaced and the strands are forced to line up as they enter the wire contacting slot, but some contact pressure is maintained on the strands due to torsional effects inherent in the lay of the wire. This is the situation illustrated in FIG. 11. Once the strands are in the slot, the shroud may be safely removed.

It would be entirely possible to design a terminal within the scope of the present invention, which would not require the use of a shroud, by increasing the dimensions to give it added strength; however, this would necessitate using a larger circuit board where space is often at a premium. An alternative for increased strength would be use of a high strength material such as beryllium copper; however, this would be much more expensive than the brass contact for which the shrouded insertion tool is primarily intended.

An important feature of the inserter, with or without the shroud, is that it is designed to insert the wire less than fully into the slots. This is accomplished by designing the outer pusher members 80, 80' to contact the circuit board when the wire reaches the stage shown in FIG. 11. This feature allows a continuing contact force to be maintained on the wire by the cantilever beam action of the opposed walls of the slots, and further precludes shearing the wire by having it bottom out in the slots.

Note that several terminating arrangements are possible with a single mounted terminal, including (1) having a single wire feed through both wire receiving portions, (2) having a single wire terminate in both wire receiving portions, and (3) terminating a distinct wire in each wire receiving portion. The best termination for stranded wire is provided in instances where a single wire is terminated in both wire receiving portions, since lateral movement of the wire on the side of either wire receiving portions 4, 4' will not destroy the lay of the wire between the wire receiving portions, thus a good electrical contact is maintained between the strands and the wire receiving slot in the other wire receiving portion by torsional forces inherent in the lay. If but one wire receiving portion is used to terminate a wire, lateral movement of the wire could unwrap the lay of the strands and cause loss of the torsional effect and resultant less certain physical and electrical contact.

The fact that the downwardly extending retaining portions 22, 22' of the terminal are spaced apart in the strip 41 of terminal devices FIG. 4, is distinctly advantegeous in that the strip can be readily fed over a track 54 as shown in FIG. 5 and the leading terminal of the strip in the guide tube 58 will be located beyond the end of the track. This leading terminal can then be severed from the strip upon downward movement of the guide punch 60, since the retaining sections 22 are outwardly spaced from the shear die 56 and the end of the track.

While the description presented above discloses a two-piece insertion tool, it should be mentioned that a one-piece tool may also be used, such tool having the inserter integral with the shroud. A tool of this type is designed such that the shroud moves over the edges of the terminal and supports them against excessive flexure while the conductor is being inserted in the slots of the terminal.

A cap may also be provided for permanent assembly to the terminal, such cap serving the function of an insertion tool as well as insulating the terminal and providing additional strain relief for the wire.

The disclosed embodiment has the wire-receiving portions 4, 4' in alignment with each other and this arrangement is desirable in that the overall dimensions of the device are minimized and the amount of material required to produce it is also minimized. However, it may be desirable to have these wire-receiving portions somewhat offset from each other in parallel spaced-apart planes. An embodiment of this type would be usefully under special circumstances. For example, the length of the web portion 16 could be somewhat reduced and the web would extend diagonally between the two offset wire-receiving portions.

A salient advantage of a terminal device in accordance with the invention, is that it can be produced in several different embodiments, as regards the slots 24, 26, 24', 26', for specialized circumstances of use. The embodiment described above has inner slots 24, 24' which are dimensioned to establish electrical contact with the core of an insulated wire and the outer slot 26, 26' are dimensioned to serve as strain relief means for a wire or wires. As an alternative, the four slots may be of increasing width from one side of the device to the other so that they can establish contact with wires of varying sizes. For example, the slot 26' may be of a width such that it will establish contact with an AWG 22 wire, the slot 24' of a width such that it will establish contact with an AWG 24 wire, the slot 24 of a width such that it will establish contact with an AWG 26 wire, and the slot 26 of a width such that it will establish contact with an AWG 28 wire. An embodiment of this type would be extremely useful in the manufacture of devices such as electronic games, or smoke detectors, which usually have a circuit board, a battery, and a coil or the like. The wires extending from the battery will ordinarily be of a comparatively coarse gage, say AWG 22, while the wires from the coil may be relatively fine, AWG 28. In the manufacture of the game device or smoke detector, a single size of terminal could be used for all of the connections from the battery and the coil to the circuit board. An embodiment of this type would not provide the same strain relief means as the embodiment described above, however, a strain relief is not always necessary, particularly where the wires are contained in a housing, such as the housing of a smoke detector.

In some circumstances it may be desirable to provide all of the slots of the same width so that they would all be wire-contacting slots. An embodiment of this type would be useful where electrical reliability is of primary importance and a strain relief is not essential. An embodiment of this type would also be useful where a maximum amount of contact area is required, for example, where the wire being connected to the terminal is of copper coated steel. Wires of this type do not deform when they are inserted into a wire-receiving slot and the lower conductivity of the steel dictates the need for increased contact area.

To cite a further example, an embodiment might be provided having two contacting slots in one of the wire-receiving portions and two strain relief slots in the other wire-receiving portion. An embodiment of this type provides redundant electrical contacts to the wire and redundant strain relief means on the wire. Furthermore, the strain relief is physically separated from the electrical contacts by the distance between the two wire-receiving portions 4, 4'.

What is claimed is:

1. A one-piece stamped and formed electrical contact terminal having wire contacting means for establishing electrical contact with an insulated wire comprising:

first and second wire-receiving portions and a mounting portion, each of said wire-receiving portions comprising an inner plate-like member and an outer plate-like member, said inner and outer plate-like members of each wire-receiving portion being in side-by-side aligned relationship and having remote ends and having inner ends, said remote ends being connected to each other by a bight section, said first and second wire-receiving portions being in spaced-apart relationship with said inner plate-like members of said first and second portions facing each other, said inner ends of said inner plate-like members being connected to each other by an integral web which extends substantially normally of said inner plate-like members, said mounting portion comprising first and second extensions on said inner ends of said outer plate-like members of said first and second wire-receiving portions respectively, said extensions extending from said inner ends initially towards each other and then laterally away from said web, each of said wire-receiving portions having wire-receiving slot means extending inwardly from said bight sections on said inner and outer plate-like members toward said inner ends of said plate-like members whereby, said terminal can be mounted in a supporting member by means of said mounting portion, and a wire can be connected thereto by aligning said wire with said slot means and moving said wire laterally of its axis and into said slot means.

2. An electrical contact terminal as set forth in claim 1, said wire-receiving slot means in each of said first and second wire-receiving portions comprising a wire-contacting slot in said inner plate-like member and a strain relief slot in said outer plate-like member, said wire-contacting slot having a width which is less than the diameter of the conducting core of the wire size for which said terminal is intended, said strain relief slot having a width which is less than the diameter of the insulation of said wire and at least equal to the diameter of said conducting core.

3. An electrical contact terminal as set forth in claim 1, said bight section of each of said wire-receiving portions comprising a sharp substantially 180 degree fold, whereby said inner plate-like member is juxtaposed with said outer plate-like member in each wire receiving portion.

4. A one-piece sheet metal stamped and formed terminal mounted on one surface of a support member, said terminal having a wire-receiving slot means, said terminal comprising:

first and second wire-receiving portions and a mounting portion, each of said wire-receiving portions comprising an inner plate-like member and an outer plate-like member, said inner and outer plate-like members of each wire-receiving portion being in side-by-side aligned relationship and having remote ends and having inner ends, said plate-like members extending substantially normally of said surface of said support member with said remote ends spaced from said surface and with said inner ends proximate to said surface, said remote ends of said plate-like members of each wire-receiving portion being connected by a bight section, said first and second wire-receiving portions being in spaced-apart relationship with said inner plate-like members of said first and second portions facing each other, said inner ends of said inner plate-like members being connected to each other by an integral web which extends substantially normally of said inner plate-like members, said mounting portion comprising first and second extensions on said inner ends of said outer plate-like members of said first and second wire-receiving portions respectively, said extensions comprising transition sections which extend toward each other and retaining sections which extend laterally of said web into an opening in said surface, said wire-receiving slot means comprising wire-receiving slots which extend inwardly from said bight sections on said inner and outer plate-like members toward said inner ends of said plate-like members of each of said first and second wire-receiving portions.

5. An electrical contact terminal as set forth in claim 4, said wire-receiving slot means in each of said first and second wire-receiving portions comprising a wire-contacting slot in said inner plate-like member and a strain relief slot in said outer plate-like member, said wire-contacting slot having a width which is less than the diameter of the conducting core of the wire size for which said terminal is intended, said strain relief slot having a width which is less than the diameter of the insulation of said wire and at least equal to the diameter of said conducting core.

6. An electrical contact terminal as set forth in claim 4, said bight section of each of said wire-receiving portions comprising a substantially 180 degree fold, said inner and outer plate sections being adjacent to each other.

7. A terminal mounted on one surface of a support member as set forth in claim 4 or claim 6, said support member comprising a circuit board having a conductor on a surface thereof, said retaining sections being soldered to said conductor.

8. A terminal mounted on one surface of a support member as set forth in claim 4 and an additional terminal which is identical to said terminal, said additional terminal being mounted on said surface beside said terminal, said terminal and said additional terminal being integral with each other by means of a connecting link between said web of said terminal and the web of said additional terminal, said terminal and said additional terminal constituting a terminal junction means for at least two wires.

9. An electrical contact terminal as set forth in claim 4, said transition sections having external bearing portions which bear against said surface offset from said opening, said bearing portions being offset from said retaining sections.

10. A continuous strip of stamped and formed electrical contact terminals which are intended for insertion into a support such as a panel-like member, each of said terminals comprising first and second wire-receiving portions and a mounting portion, each wire-receiving portion comprising an inner and an outer plate-like member, each of said plate-like members having an inner end and a remote end, said remote ends of each wire-receiving portion being connected by a bight section, said first and second wire-receiving portions of each terminal being in spaced-apart relationship with said inner plate-like members facing each other, said inner ends of said first plate-like members being connected by an integral web which extends transversely of the axis of said strip, each of said wire-receiving portions having wire-receiving slot means extending inwardly from said bight sections on said inner and outer plate-like members towards said inner ends of said plate-like members, said mounting portion of each of said terminal comprising first and second extensions on said inner ends of said outer plate-like members of said first and second wire-receiving portions respectively, and extensions extending from said inner ends initially towards each other and then laterally away from said web, said terminals being in side-by-side relationship along the length of said strip with said first and second wire-receiving portions of each terminal being coplanar with the first and second wire-receiving portions respectively of adjacent terminals, adjacent terminals in said strip being connected to each other by connecting links extending between said webs of said adjacent terminals whereby, the leading terminal of said strip can be removed from said strip by shearing said connecting link between said leading terminal and the next adjacent terminal, and said leading terminal can be mounted in a support by inserting said extensions into said opening in said support.

* * * * *